United States Patent [19]

Miyake

[11] 4,403,486

[45] Sep. 13, 1983

[54] PIN TUMBLER LOCK

[75] Inventor: Mitsunori Miyake, Osaka, Japan

[73] Assignee: Kabushiki Kaisha Goal, Osaka, Japan

[21] Appl. No.: 216,867

[22] Filed: Dec. 16, 1980

[30] Foreign Application Priority Data

Dec. 28, 1979 [JP] Japan ..... 54-173814

[51] Int. Cl.[3] ..... E05B 15/14; E05B 25/00; E05B 27/06; E05B 35/08

[52] U.S. Cl. ..... 70/383; 70/338; 70/378; 70/364 A

[58] Field of Search ..... 70/383, 382, 378, 376, 70/392, 384, 337, 338, 340, 341, 342, 343; 364 A, 276

[56] References Cited

U.S. PATENT DOCUMENTS

| | | | |
|---|---|---|---|
| 2,427,837 | 9/1947 | Connell | 70/383 |
| 3,090,219 | 5/1963 | Levin | 70/383 |
| 3,462,983 | 8/1969 | Evanish | 70/383 |
| 3,516,271 | 6/1970 | Nelson | 70/383 |
| 3,595,043 | 7/1971 | Williams | 70/383 |
| 4,116,026 | 9/1978 | Flint | 70/383 |

*Primary Examiner*—Robert L. Wolfe
*Attorney, Agent, or Firm*—Holman & Stern

[57] ABSTRACT

A tumbler lock comprising housing pockets in an outer housing and plug pockets in a cylindrical plug rotatably mounted in the housing holding slidably outer and inner pins respectively, auxiliary pockets in the housing corresponding to the plug pockets at a certain rotated position circumferentially spaced from the housing pockets holding therein auxiliary pins, and change pins which may be interpositioned between the inner, outer and auxiliary pins and interchanged between the respective pockets so that the change pins may be freely shifted to reset the back to be operated by different keys.

9 Claims, 19 Drawing Figures

PIN TUMBLER LOCK

BACKGROUND OF THE INVENTION

1. Field of the Invention

The present invention relates to a pin tumbler lock.

2. Description of the Prior Art

Tumbler locks have been configured essentially permitting absolutely no change in unlocking conditions. On the other hand, a variety of more or less flexible locks have been provided recently, which may be re-set to operate under different unlocking conditions to repel the original key used during a construction work. However, such a lock of the prior art has such drawbacks as alteration of the unlocking condition is confined to only once and moreover provides no free conditioning so that the existing lock must be replaced if the current key is lost or to prevent others from attempting a trespass. More flexible locks have been recently provided permitting multiple re-setting after manufacture. The U.S. Pat. No. 3,999,413 discloses for example a lock assembly of the wafer tumbler type.

On the other hand, although a lock assembly of the pin tumbler type is also provided to permit multiple re-setting, it has generally remained intricate in construction and no simple assembly is available as the wafer type. The U.S. patent application Ser. No. 393,493 filed on Aug. 28, 1964 for example relates to a lock assembly of the pin tumbler type, but the lock of this reference comprises an adjustment mechanism which changes the length of tumblers and is operable from outside by means of a special element for exclusive use, bearing a disadvantage of an intricate and large construction so that it may be inapplicable to a low cost, simple lock.

SUMMARY OF THE INVENTION

An object of this invention is to provide means of easy replacement of a key with a different key for a lock of the pin tumbler type.

Another object of the present invention is to provide a lock of the pin tumbler type which features plurality of re-setting, with a simple inside mechanism so that an improved lock can be made available with respect to productivity, manufacturing cost and durability.

Another object of the invention is to provide a lock of the pin tumbler type having a considerable number of unlocking conditions.

Another object of the invention is to provide a lock of the pin tumbler type which permits a reversible change of the unlocking condition without decreasing the number of unlocking conditions by replacement of keys.

Another object of the invention is to provide a lock assembly of the pin tumbler type which allows replacement of a key by means of operating the current key or otherwise the re-setting key eliminating an intricate operation mechanism for the exclusive key replacement purpose.

The characteristics of the present invention is to provide a cylinder pocket in the inner surface of the cylindrical housing as well as a plug pocket in the plug to house upper and lower pins which are slidable radially in the pockets. An auxiliary pocket holding an auxiliary upper pin free to slide therein is provided in the housing to correspond to the plug pocket at a certain rotated distance from the housing pocket. Further, a change pin is so used that it shifts its position from the plug pocket to the auxiliary pocket and vice versa where the plug pocket and auxiliary pocket correspond to each other.

As described in the previous paragraph, the change pin is either interpositioned between the upper pin in the housing pocket and the lower pin in the plug pocket or removed therefrom. More particularly, the projected height of a key which pushes up the lower pin changes depending on agreement of the slide line which is the border between the cylinder and plug, with the border between the upper and lower pins or with the border between the upper pin and change pin. This means a replacement of the key with a different key. To replace the key, the current key or otherwise the paired key for replacing operation (hereinafter referred to as a re-setting key) is turned to rotate the plug till the plug pocket is brought to the position in agreement with the auxiliary pocket, removed from that position, and a new key or relative re-setting key is inserted to be turned back to the original position. In case a re-setting key is employed, the plug may be prevented from being rotated by a key to the pocket mating position. The change pin is movable into the auxiliary pocket from the plug pocket leaving the lower pin, but unmovable from the plug pocket into the housing pocket, which is for the purpose on one hand that the border between the change pin and lower pin is not brought into agreement with the border between the cylindrical housing and the plug at the mating position of the plug pocket and housing pocket, and on the other hand the border between the change pin and lower pin can be brought into agreement with the border between the housing and the plug at the mating position of the plug pocket and auxiliary pocket. Such construction is possible by way of providing means of concavo-convex engagement of the change pin with the lower pin and of releasing the engagement only at the mating position of the plug pocket and auxiliary pocket. Means to release the engagement of the change pin and the lower pin may comprise application of a magnetic force, or restoring force of a spring, or component force of the turning effort of the plug extended to the change pin to slip up into the auxiliary pocket.

As described above, the plug is rotatable when the upper face of the change pin is brought into agreement with the slide line at the mating place of the auxiliary pocket and the plug pocket, and in addition when the lower face of the change pin is in agreement with the slide line. Accordingly, said mating position permits the use of not only the current key or the re-setting key but a different key or the relative re-setting key whose height of the key projection is proportionately higher or lower by the length of the change pin. Therefore, keys can be replaced at this position. Further, if another new key or the relative re-setting key is inserted and turned back to the mating position of the plug pocket and the housing pocket, the original key or the relative re-setting key is no longer effective to rotate the plug. This is because either of the borders composed by the upper pin, lower pin and the change pin no longer agrees with the slide line between the housing and plug by insertion of the original key due to the change pin having been either removed or added.

According to the present invention, a change pin is used in the manner in which its position is interchanged between the auxiliary pocket and plug pocket so that a re-setting mechanism for changing the unlocking condition can be considerably simplified. The position of a change pin being reversibly changeable, alteration of the unlocking condition is also reversibly possible. Since the lock of this invention freely permits re-setting of the unlocking condition for vertually any number of times by operating a key or the relative re-setting key to change the position of the change pin, there is absolutely no need of taking the lock apart for re-setting purposes. If the current key is lost, the owner, by changing the unlocking condition without replacing the lock, can make the lost key no longer effective to operate the lock, preventing use for a trespass or the like. If the lock of this invention is mounted to a hotel guest room door, problems that may arise from a missing key or unauthorized use of a duplicated key can be eliminated by changing the unlocking condition each time a guest checks out. Further, the lock of this invention permits the selection of a number of reversible re-setting conditions, which is not found in the prior art, so that it may be advantageously operated by a master-key at a building site where the original key needs to be replaced with a new key after the construction. Re-setting operation is considerably simple, since the unlocking condition can be changed by turning the original key or the paired re-setting key to rotate the plug onto the position of the auxiliary pocket, removing the original key or the original paired re-setting key, and inserting a new key or a new paired re-setting key to turn the plug back onto its original position. Since there is a pair of conditions at each position of the auxiliary pockets, n number of auxiliary pockets will make an aggregate of $2^n$ conditions. By dividing a change pin into two, $3^n$ conditions will be available and $4^n$ by dividing it into 3. On the other hand, a manufacturer of locks will find a particularly improved productivity in the lock of this invention, because each pair of pins for pin tumblers can be fabricated and assembled in the same way to a tumbler lock which provides a number of unlocking conditions by merely changing the position of the change pins.

Further characteristics of the invention will be explained more in detail in the subsequent description with reference to the accompanying drawings.

BRIEF DESCRIPTION OF THE DRAWINGS

FIG. 8 is a cross-sectional view like FIG. 7, but with the first key turned through 90° clockwise about its longitudinal axis;

FIG. 9 is a cross-sectional view like FIG. 8, but with the first key replaced with the second key;

FIG. 10 is a cross-sectional view like FIG. 9, but with the second key turned through 90° counter-clockwise about its longitudinal axis;

FIG. 11 is an enlarged cross-sectional view of a side section of certain components shown in FIG. 9;

FIG. 17 is a partial cross-sectional view showing the manner in which replacement of the key is completed;

FIG. 18 is a partial cross-sectional view showing the manner in which the original key is inserted.

DESCRIPTION OF THE PREFERRED EMBODIMENT

Figure 1:
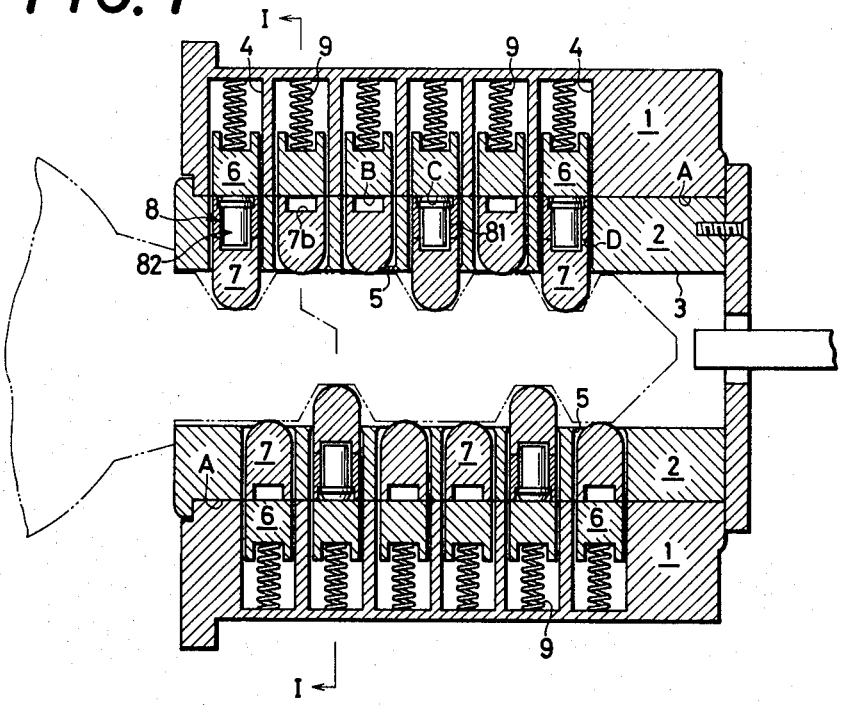
FIG. 1 is a cross-sectional view of one embodiment of the invention.

FIGS. 1 to 6 show the preferred embodiment of a lock assembly of the two-sided pin tumbler type according to the present invention. Reference number 1 designates a cylindrical housing and 2, a cylinder plug. Said cylinder plug 2 is rotatably mounted in the cylindrical housing 1 along the slide line A and is functional to operate a working lever not shown in the drawings. Reference number 3 designates a key-slot. Reference number 4 designates a series of pockets provided in the inner surface of the cylindrical housing 1, extending radially therein and being displaced from one another along the longitudinal axis of the housing. Reference number 5 designates a series of plug pockets provided in the cylinder plug 2 to correspond with the mating housing pockets 4. The plug pockets 5 face the mating cylinder pockets 4 at a certain rotated position. Each cylinder pocket 5 and plug pocket 4 houses an upper pin 6 and lower pin 7 respectively and a change pin 8 is allocated to the fixed pocket interpositioned between said upper pin 6 and lower pin 7. Said upper pin 6 is supported within the housing pocket 4, and is spring biased from the bottom by means of a spring 9. The lower pin 7 is slidably inserted into the plug pocket 5 and is provided with an engaging cavity 7*b* on the upper end 7*a*.

Figure 6:
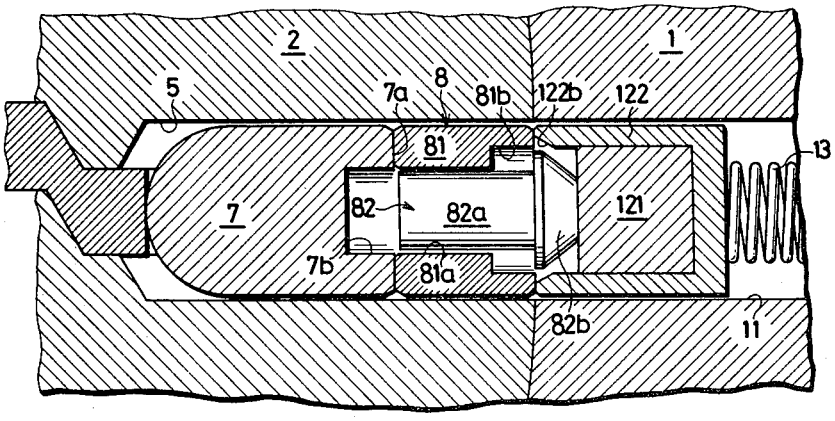
FIG. 6 is an enlarged cross-sectional view of certain components shown in FIG. 4.

Said change pin 8 as shown enlarged in FIG. 6 comprises a cylindrical body 81 and a working pin 82 slidable into said body 81. Said working pin 82 is formed with a magnetic material such as iron to be attracted by a magnet. The working pin 82 comprises a shaft 82*a* and a head 82*b*, the head 82*b* being tapered to form a frustum of a cone. Said cylindrical body 81 is provided with a hole 81*a* through which passes the shaft 82*a* of said working pin 82 and a receiving cavity 81*b* into which the head 82*b* of said working pin 82 is seated. When the working pin 82 is seated in the cylindrical body 81, the upper end of the head 82*b* of the working pin 82 and the upper end of the cylindrical body 81 are leveled even with the shaft 82*a* of the working pin 82 partially protruding outside the lower end of the cylindrical body 81. The projected part of the shaft 82*a* performs engagement with the receiving cavity 7*b* of said lower pin 7.

Therefore, the lower pin 7 is always in engagement with the change pin 8 so long as the change pin 8 is applied. Each of those pins 6, 7 and 8 overlaps each other within the pockets 4 and 5, composing a border B between the upper pin 6 and lower pin 7, a border C between the upper pin 6 and change pin 8 and a border D between the change pin 8 and lower pin 7. The border D between said change pin 8 and lower pin 7 always remains at the side of the lower pin 7 in a cavernous state.

Assuming that the first key 10 representing the current key or the paired re-setting key is inserted into the key-slot 3, when the upper guide edge 10*a* and the lower guide edge 10*b* of said first key 10 push to move each lower pin 7, bringing said border B or C into agreement with said slide line A, the plug 2 becomes rotatable within the cylindrical housing 1. Otherwise, rotation of the plug is restricted.

In addition to the housing pockets 4, said cylindrical housing 1 is provided with auxiliary pockets 11 arranged at an angular distance a 90° from the position of said cylindrical housing pockets 4. The auxiliary pockets may be allocated to correspond to all of said cylindrical housing pockets 4 but this will not always be necessary. Furthermore, said angular distance may not necessarily be 90°. An auxiliary upper pin 12 is supported by a spring 13 within the auxiliary pocket 11. As shown enlarged in FIG. 6, the auxiliary upper pin 12 comprises a magnet 121 and a casing 122 which houses the magnet 121, the inside wall on the casing 122 being tapered to shape a countersink 122*b* to match the tapered head 82*b* of said working pin 82. The magnet 121 is seated in the casing 122 and fixed in its recess to attract said working pin 82 and partially pull the head 82*b* of the working pin 82 into said casing 122.

As has been described, the cylindrical housing 1 being provided with an auxiliary pocket 11 paired with the housing pocket 4, said plug pocket 5 has a passage linked not only with the corresponding housing pocket 4 but also with the paring auxiliary pocket 11. Said change pin 8 is either positioned on the side of the plug pocket 5 or held inside the auxiliary pocket 11.

Figure 2:
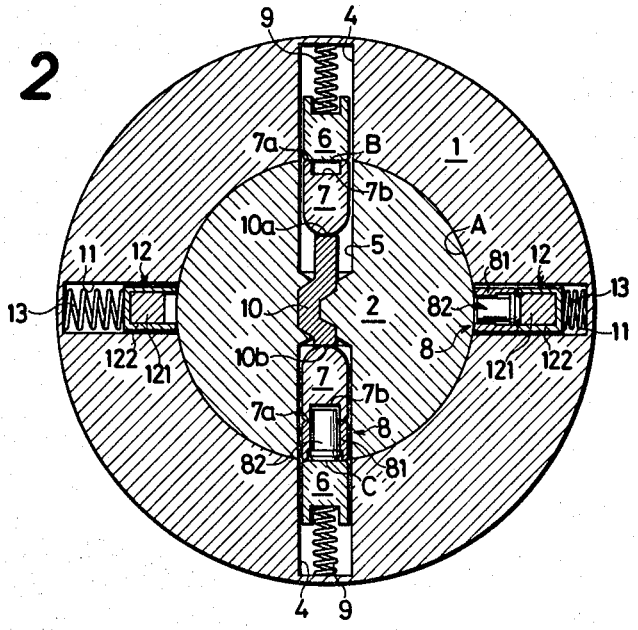
FIG. 2 is a cross-sectional view of the lock assembly of FIG. 1 with the first key inserted, taken essentially along the lines I—I of FIG. 1.

Performance of the embodiment will now be described with reference to FIGS. 2 to 5 showing operating conditions at the cross section taken along the lines I—I of FIG. 1. As shown in FIG. 2, if the first key 10 is inserted into the key-slot 3, the upper guide edge 10*a* of the first key 10 pushes up the lower pin 7, bringing the border B between the lower pin 7 and upper pin 6 into agreement with the slide line A. On the other hand, the lower guide edge 10*b* of the first key 10 pushes down the lower pin 7, bringing the border C between the upper pin 6 and the change pin 8 which engages with said lower pin 7 into agreement with the slide line A. The cylinder plug 2 is rotatable when said condition is satisfied at other positions as shown in FIG. 1.

Figure 3:
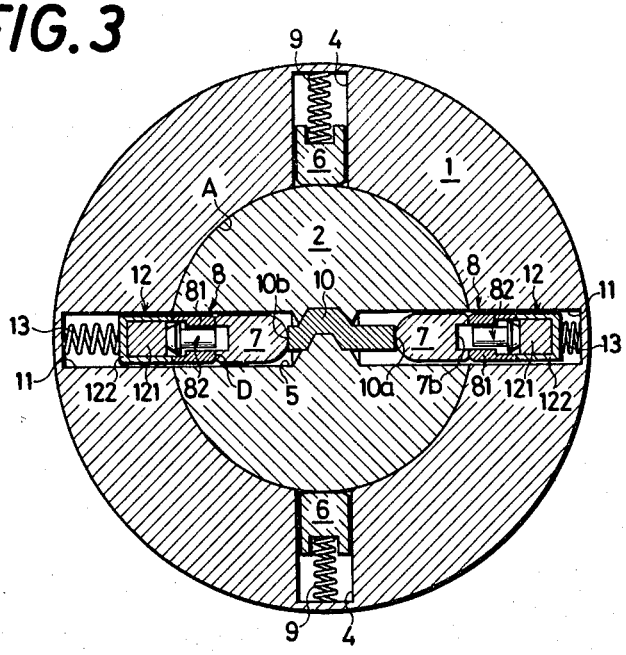
FIG. 3 is a cross-sectional view like FIG. 2, but with the first key turned through 90° clockwise about its longitudinal axis.

Assuming that the first key 10 which satisfies said condition is turned through 90° to the right, the plug pockets 5 and 5 correspond to the auxiliary pockets 11 and 11 respectively at the diagrammatical left and right respectively. FIG. 3 shows such a condition, under which the change pin 8 which has been turned together with the cylinder plug 2 faces the auxiliary pocket 11 shown at the diagrammatical leftside and the working pin 82 is attracted to the magnet 121. Therefore, a part of the head 82*b* of the working pin 82 is admitted into the casing 122 of the auxiliary upper pin 12 and at the same time the shaft 82*a* of the working pin 82 is released from the engaging cavity 7*b* of the lower pin 7.

Figure 4:
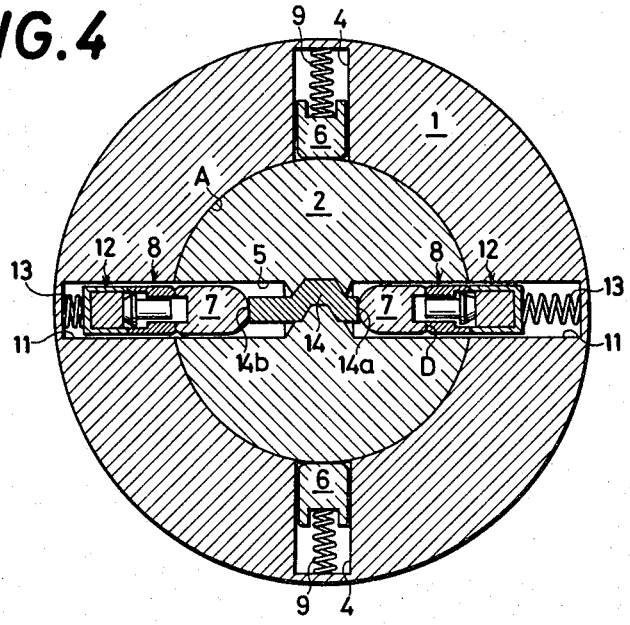
FIG. 4 is a cross-sectional view like FIG. 3, but with the first key replaced with the second key.

Now, if the first key 10 is pulled out at this position and the second key 14 which is a new key or a new re-setting key is inserted, the condition of the relative components changes as shown in FIG. 4. More particularly, the radius length between the axis of rotation of the second key 14 and its upper guide edge 14*a* is shorter than that represented by the upper guide edge 10*a* of the first key 10 by the size of the cylindrical body 81 of said change pin 8, and the distance to the lower guide edge 14*b* of the second key 14 is longer than that represented by the lower guide edge 10*b* of the first key 10 by the size of the cylindrical body 81 of said change pin 8. Therefore, as shown in the drawing, the left change pin 8 is released from retention by the lower pin 7 and pushed into the left-side auxiliary pocket 11, aligning the border D between the changer pin 8 and lower pin 7 with the slide line A. In the right-side auxiliary pocket 11 in FIG. 4 the change pin 8 is pushed out of the auxiliary pocket 11 leaving only a part of the head 82*b* of the working pin 82 attracted by the magnet 121 in the casing 122. If the second key 14 is turned back through 90° the condition changes into the one shown in FIG. 5. It will be obviously noted upon comparison of FIG. 5 with FIG. 2 that the change pin 8 has changed its position between the corresponding plug pocket 5 and the auxiliary pocket 11. Specifically, the unlocking condition has been changed. The lock of this invention is configured so that the cylinder plug 2 is not rotatable with a matching key onto the assigned position where the plug pocket 5 agrees with the auxiliary pocket 11 in case a re-setting key is used. If the second key 14 is pulled out under the condition shown in FIG. 5 for replacement with the first key 10, the slide line A being non-aligned with the borders D and B, the cylinder plug 2 is prevented from rotating.

Figure 5:
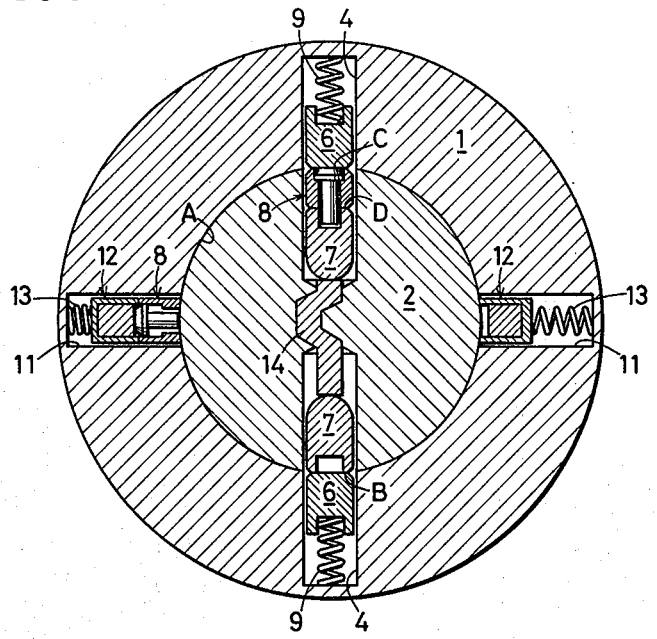
FIG. 5 is a cross-sectional view like FIG. 4, but with the second key turned through 90° counter-clockwise about its longitudinal axis.

Furthermore, the first key 10 can be turned on from the position shown in FIG. 3 or the second key 14 from the position in FIG. 4 to that in FIG. 5, which may be best described with reference to FIG. 6 which is an enlarged view of the right-side auxiliary pocket 11 shown in FIG. 4. The working pin 82 being pushed into the side of the auxiliary upper pin 12 passing over the slide line A, said working pin 82 may not seem to be movable. However, both the head 82*b* of the working pin 82 which extrudes from the slide line A and the countersink 122*b* on the opening end of the casing 122 of the auxiliary upper pin 12 being tapered, a turning effort extended to the cylinder plug 2 from outside and a resultatnt component of a force generating in the direction of the tapered face of the countersink 122*b*, will press the head 82*b* of the working pin 82 to the tapered countersink 122*b* and guide it in the direction of the slide line A to slip down the working pin 82 overcoming the attraction of the magnet 121. The reason for providing the engaging cavity 7*b* on the upper end 7*a* of said lower pin 7 is to bring the upper end 7*a* of the lower pin 7 into agreement with the slide line A when the lower pin 7 is pushed up to shift the change pin 8 from the plug pocket 5 into the auxiliary pocket 11, and to release engagement of the lower pin 7 and change pin 8. The function of the lower pin 7 and change pin 8 generally proves unsuccessful if the concavo-convex relation is reversed.

FIGS. 7 to 11 show another embodiment wherein the upper pin 6 and lower pin 7 are identical to the previously described embodiment but a change pin 8, the accompanying auxiliary pocket 11 and the auxiliary upper pin 12 are different. The change pin 8 comprises a small cylindrical projection 83 which is received by the cavity 7b of the lower pin 7, a large cylindrical body 84 of which sliding is guided by the inside wall of the plug pocket 5 and a tapered part 85 extending between said large body portion 84 and said small projection 83. The auxiliary pocket 11 is shaped to a stepped hole. More particularly, the auxiliary pocket 11 has an opening 111 whose diameter is identical to that of said plug pocket 5 and an enlarged hole 113 beyond the enlarging step 112 which is provided slightly inside the slide line A. Further, an auxiliary upper pin 12 is a stepped pin having a projection 123 and the magnet 121 is not used. The projection 123 of said auxiliary upper pin 12 has a diameter interfitting in said opening 111 and a length identical to that of the depth of the opening 111 of said auxiliary pocket 11.

Figure 7:
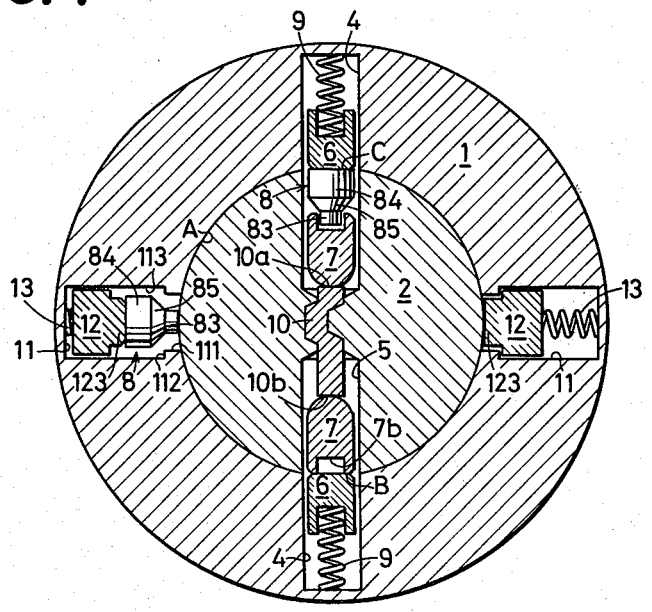
FIG. 7 to 11 show another embodiment, FIG. 7 corresponding to the cross section of the lock assembly of FIG. 1 taken along the lines I—I with the first key inserted.
Figure 8:
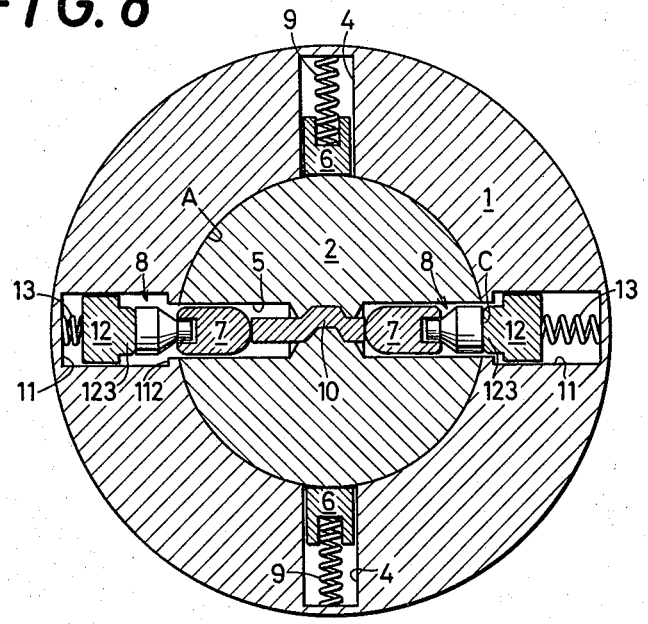

Now, operation of the lock according to this embodiment will be described. FIG. 7 shows that the first key 10 is inserted into the key-slot 3, wherein the upper guide edge 10a of the first key 10 pushes up the lower pin 7 bringing the border C between the change pin 8, which engages with the lower pin 7, and the upper pin 6 into agreement with the slide line A on one hand, and on the other, the lower guide edge 10b of the first key 10 pushes down the lower pin 7, bringing the border B between said lower pin 7 and upper pin 6 into agreement with the slide line A. If the first key 10 is turned on to the right through 90° under this condition, the lock is conditioned as shown in FIG. 8. As in the case of the previous embodiment, if the lock is positioned so that under which the auxiliary pocket 11 corresponds to the plug pocket 5 by a turn of the cylinder plug 2, the auxiliary pin 12, the change pin 8 and lower pin 7 are always overlapped with each other. It is possible to turn the first key 10 further ahead from the state shown in FIG. 8, which will be described later with reference to FIG. 11.

Figure 9:
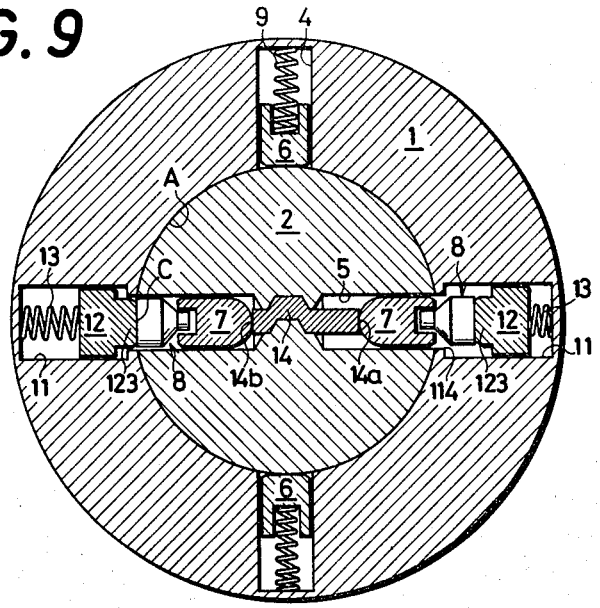
Figure 10:
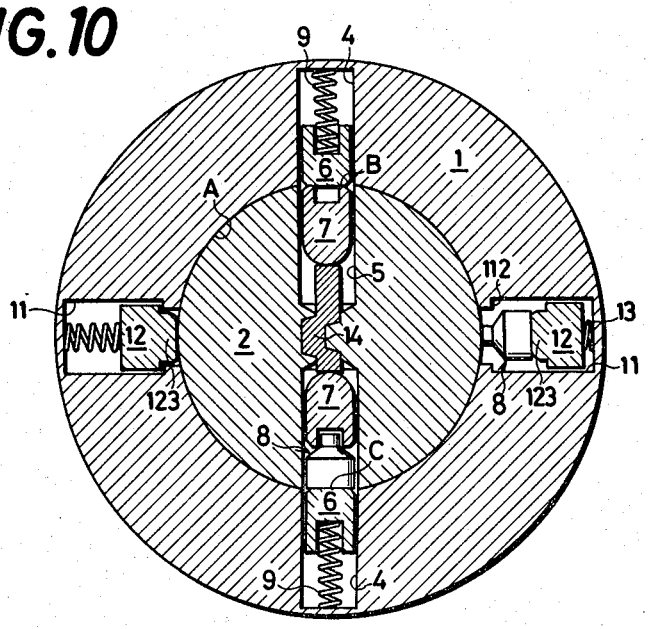
Figure 11:
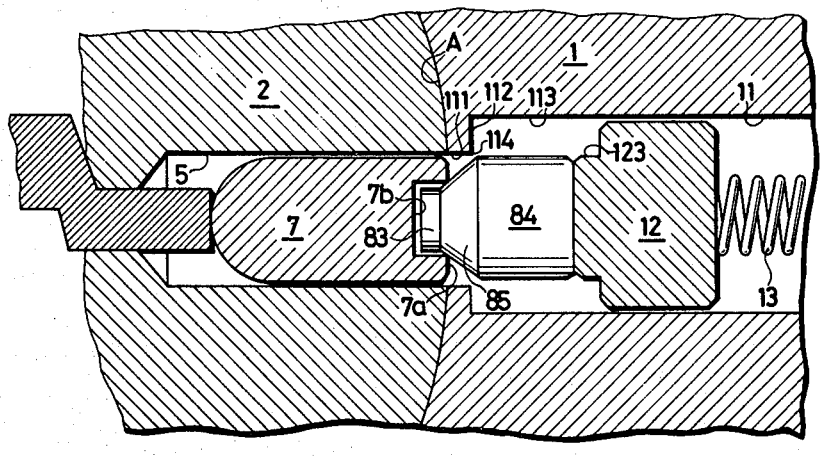

If the first key 10 is removed and the second key 14 is inserted under the condition in FIG. 8, the lock will be positioned as shown in FIG. 9. The upper guide edge 14a of the second key 14 pushes up the lower pin 7 to shift the change pin 8 into the auxiliary pocket 11 shown at the right-side of the drawing, bringing the upper end 7a of the lower pin 7 into alignment with the slide line A. On the other hand, the pushing stroke of the lower pin 7 by the lower guide edge 14b of the second key 14 decreases, and the change pin 8 is pushed out of the auxiliary pocket 11 shown at the left-side of the drawing, bringing the border C between the change pin 8 and auxiliary pin 12 into alignment with the slide line A. If the second key 14 is turned counter-clockwise through 90° from the position in FIG. 9, the lock will be positioned as shown in FIG. 10. It will be obviously noted by comparing FIG. 10 with FIG. 7 that the position of the change pin 8 has been interchanged between the corresponding plug pocket 5 and auxiliary pocket 11. This means that the unlocking condition has been changed. Under this condition, therefore, the lock is no longer turnable by the first key 10. FIG. 11 is an enlarged diagram of the right-side auxiliary pocket 11 shown in FIG. 9, which is the same as the left-side auxiliary pocket 11 in FIG. 8, wherein the cylinder plug 2 is rotatable because of the tapered part 85 arranged on the change pin 8 and the enlarging step 112 provided in the auxiliary pocket 11. More particularly, if the cylinder plug 2 is turned along the slide line A under the condition shown in FIG. 11, the tapered part 85 of the change pin 8 comes into contact with the corner 114 of said enlarging step 112 due to the resultant component of a force generated in the tapered direction, which slips up the change pin 8 releasing the small diametrical projection 83 of change pin 8 from engagement with the cavity 7b of lower pin 7. Only the upper end 7a of lower pin 7 therefore comes in alignment with the slide line A permitting the rotation. In this instance, if the concavo-convex relation is reversed, rotation is restricted even though the lower pin 7 is disengaged from the change pin 8.

Factors common to the above described two embodiments are: the positions of change pin 8 is reversibly changeable by means of the auxiliary pocket 11 in the cylindrical housing 1; the change pin 8 is changeable in the auxiliary pocket 11 by rotating the cylinder plug 2, i.e. the vertically positioned key being turned through 90° to produce the change at a horizontal position according to the embodiment; the key is replaced at this horizontal position; and not only said first key 10 and the second key 14, but other keys are applicable at the horizontal position. In addition to the foregoing, however, if a new key, the second key 14 for example, is inserted and turned back to the upright position, only the second key 14 is effective at this vertical position. Furthermore, the number of unlocking positions will be $2^n$ if the number of the auxiliary pockets 11 is n and is changeable reversibly, and therefore is auxiliary pockets 11 are provided to correspond to all the cylindrical housing pockets 4, $2^l$ reversible unlocking conditions will be available with l number of housing pockets 4. This means that if 12 housing pockets are provided on the upper and lower part as shown in FIG. 1 for example, a lock will provide $12^{12}$ or 4,096 unlocking conditions. Furthermore, such a lock may be provided with a variety of combinations of different length of the change pins 8, lower pins and upper pins for example to compose many groups, each having 4,096 conditions. Further, according to the embodiments, engagement of the lower pin 7 with the change pin 8 is conducted in the cavity provided on the lower pin 7 and the projection on the change pin 8.

Figure 12:
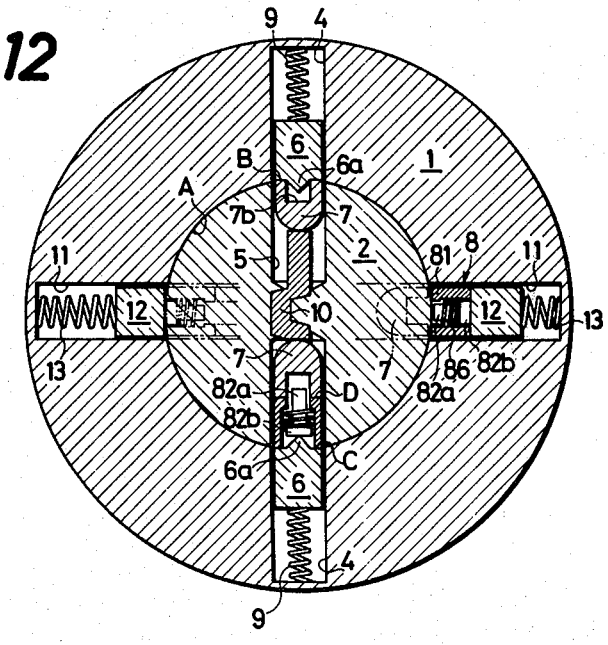
FIG. 12 shows another embodiment, corresponding to the cross sectional view shown in FIG. 2.

Another embodiment is shown in FIG. 12. This embodiment has a strong resemblance to the embodiment previously described with reference to FIGS. 1 to 6 with the exception that the upper pin 6 is provided with a pointed edge 6a, the auxiliary pin 12 needs no magnetic material, a working pin 82 of the change pin 8 is spring biased so that the head 82b and shaft 82a respectively of the working pin 82 are always leveled with the cylindrical body 81 of change pin 8, i.e. the top and bottom of the change pin 8 are always held even by means of a spring 86, and unlike the previous embodiments the head 82b of working pin 82 need not be tapered to a shape of a frustum of a cone.

The pointed projection 6a of said upper pin 6 pushes down the working pin 82 by that length to bring the lower pin 7 into engagement with the change pin 8, and as regards the relation between the lower pin 7 and upper pin 6 as well as the relation between the change pin 8 and upper pin 6, the upper pin 6 slips up its pointed projection 6a into the housing pocket 4 resisting the spring 9 as the cylinder plug is turned so that rotation of the cylinder plug 2 is not prevented. To replace a key, the first key 10 is first turned to the right through 90° under the condition shown in FIG. 12. The lower pin 7 and change pin 8 are positioned as shown by imaginary lines in FIG. 12. The first key 10 is then removed under this condition and the second key not shown in the drawing is inserted and turned back through 90° to complete re-setting. Under this condition, even if the original first key 10 is inserted, rotation is restricted owing to non-alignment of the slide line A with borders B, C and D.

Figure 13:
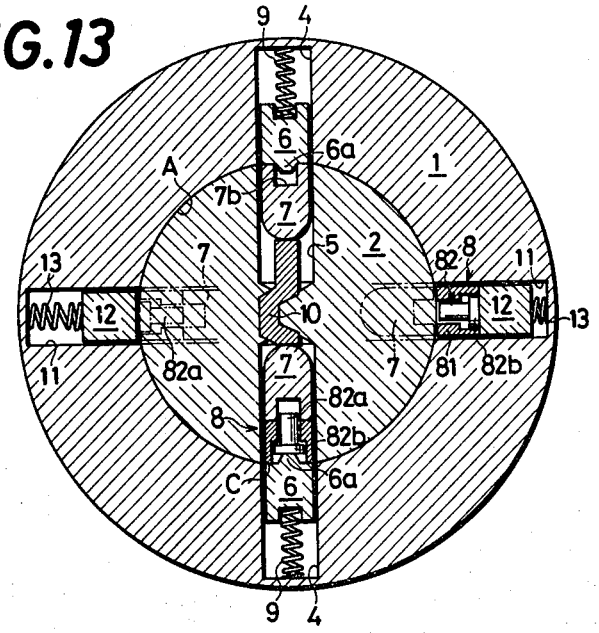
FIG. 13 shows still another embodiment, corresponding to the cross sectional view shown in FIG. 2.

Still another embodiment is shown in FIG. 13. This embodiment also strongly resembles the previously disclosed embodiment referred to in FIGS. 1 to 6. The upper pin 6 is provided with a pointed edge 6*a* in the same manner as in the aforementioned embodiment shown in FIG. 12. Instead of an auxiliary upper pin 12, a working pin 82 of the change pin 8 is a magnet to attract the working pin 82 to the auxiliary upper pin 12 in the auxiliary pocket 11. To replace a key, the first key 10 is turned to the right through 90° from the condition shown in FIG. 13, when the lower pin 7 and change pin 8 in the cylinder plug 2 shown at the lower part of the drawing slip up the pointed edge 6*a* of upper pin 6 into the housing pocket 4 at the initial stage of rotation resisting a spring 9. The lower pin 7 and change pin 8 when turned through 90° are positioned as shown by imaginary lines in the drawing. The change pin 8 has been disengaged with the lower pin 7 by this time. Now the first key 10 is removed, the second key not shown in the drawing is inserted and turned back through 90°, replacement of a key is completed.

Figure 14:
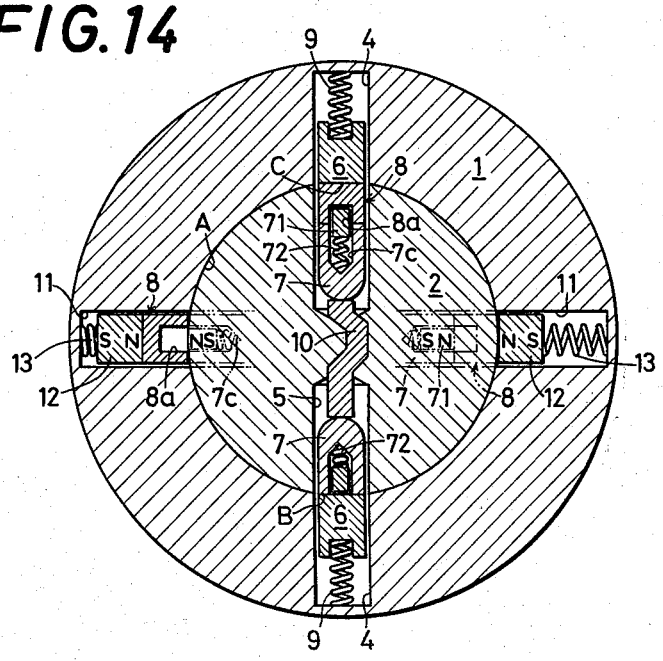
FIG. 14 also shows another embodiment, corresponding to the cross sectional view shown in FIG. 2.
Figure 15:
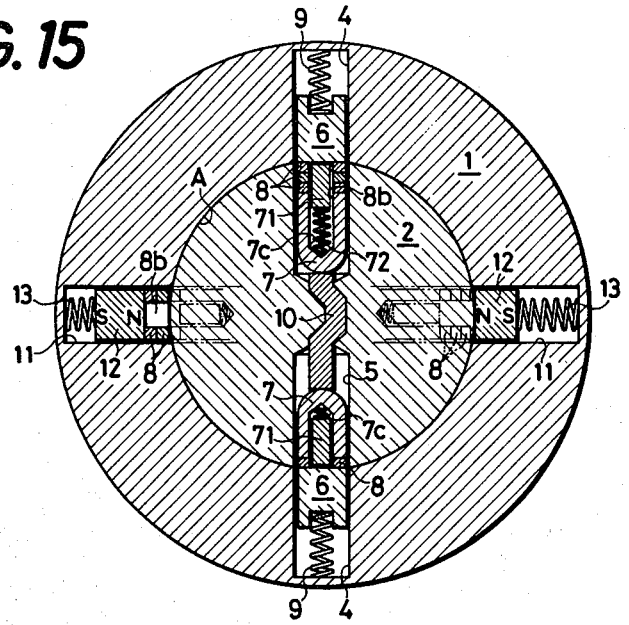
FIG. 15 shows still nother embodiment, corresponding to the cross sectional view shown in FIG. 2.

Still another embodiment is shown in FIG. 14. According to this embodiment, the lower pin 7 is provided with a cavity 7*c*, within which an engaging element 71 is supported by means of a spring 72 to push it forward to extend from said casing cavity 7*c* at all times. The force of spring 72 is weaker than the spring 9 in the housing pocket 4. The engaging element 71 comprises a bar magnet and is positioned with its leading N pole radially outwardly and trailing S pole radially inwardly. Change pin 8 is also provided with a casing cavity 8*a* to receive the engaging element 71. The auxiliary upper pin 12 comprises a magnet and is arranged with its N pole radially inwardly and S pole radially outwardly. The poles are arranged so that the auxiliary upper pin 12 and the engaging element 71 repel each other. To replace a key, the first key 10 is turned to the right through 90° from the condition in FIG. 14 in which the key is inserted, and the lower pin 7 and change pin 8 are positioned as shown in imaginary lines in FIG. 14. At this position, the engaging element 71 is repelled to disengage with the change pin 8 by the magnetic force of the auxiliary upper pin 12. If the first key 10 is removed under this condition and the second key not shown in the drawing is inserted and turned back through 90°, replacement of a key is completed. An embodiment according to FIG. 15 shows a plurality of change pins 8 positioned between the upper pin 6 and lower pin 7, in this instance a maximum of 3 change pins 8 being interpositioned between the upper pin 6 and lower pin 7. Although the embodiment shows that the change pin 8 appears to be divided into 3 pieces, an engaging hole 8*b* is provided through the center of the change pin 8 to permit projection of the engaging element 71 therethrough. To replace a key, assuming the lock condition is as per FIG. 15, with the first key 10 inserted, the first key 10 is turned to the right through 90° to mate the auxiliary pocket 11 and plug pocket 5 with each other, and the lower pin 7 and change pin 8 are positioned as shown in imaginary lines in FIG. 15. Under this condition, there are always 3 change pins 8 interpositioned between the auxiliary upper pin 12 and lower pin 7 with the engaging element 71, repelled by a magnetic force of the auxiliary upper pin 12, being released from engagement with all the change pins 8. If the first key 10 is removed under this condition and the second key not shown in this drawing is inserted and turned back through 90°, replacement of a key is completed. At this time, any number of change pins 8, 3 pieces, 2 pieces, 1 piece only or none at all, may be left in the auxiliary pocket 11. Therefore, referring to the unlocking condition, since there are 4 unlocking conditions at each place, n number of auxiliary pockets 11 will aggregate to $4^n$ unlocking conditions and reversible to change. If all the 12 housing pockets 4 are provided with auxiliary pockets 11 with reference to FIG. 1 for example, $4^{12}=16{,}777{,}216$ unlocking conditions will be available.

Figure 16:
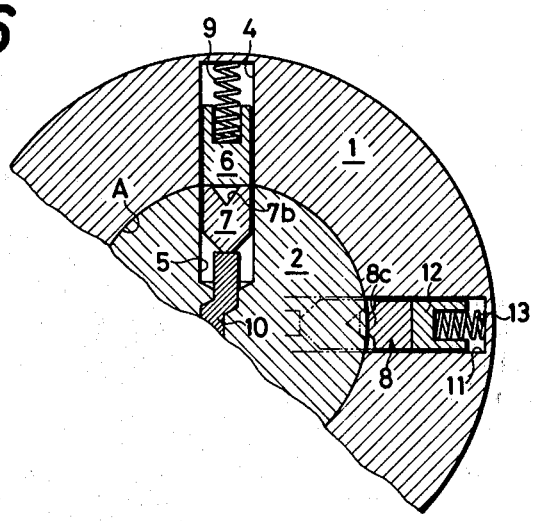
FIGS. 16 to 18 show another embodiment, FIG. 16 corresponding to the cross sectional view shown in FIG. 2.
Figure 17:
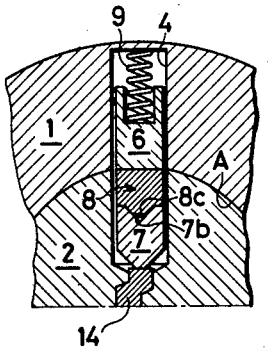
Figure 18:
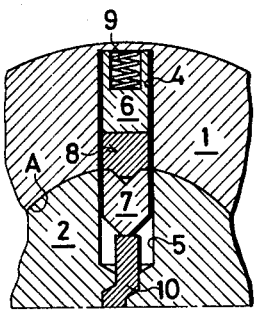

FIGS. 16 to 18 show still another embodiment. According to this embodiment, the lower pin 7 is provided with an engaging cavity 7*b* and the change pin 8 with a pointed edge 8*c* which can slip up to be received by the engaging cavity 7*b*. The embodiment is characteristic in that the depth of the housing pocket is equal to the total length of the upper pin 6 and change pin 8 less the height of said pointed edge 8*c*. To replace a key, the first key 10 under the condition shown in FIG. 16 is turned to the right through 90° to condition the lower pin 7 and change pin 8 as shown by imaginary lines in the drawing, so that the change pin 8 engages with the lower pin 7 with only its pointed edge 8*c* projecting into the plug pocket 5 from the auxiliary pocket 11. The first key 10 can of course be turned further on, because the pointed ege 8*c* of the change pin 8 slips up into the auxiliary pocket 11. Then, if the first key 10 is removed at its rotated position through 90°, and the second key 14 is inserted and turned back through 90°, replacement of a key is completed as shown in FIG. 17. In this instance, even though the second key 14 is removed and the original first key 10 is inserted, the key is no longer rotatable because the upper pin 6 is blocked by the bottom of the housing pocket 4 preventing the change pin 8 from slipping up into the housing pocket 4.

Replacement of the change pin 8 is automatically performed by operating a key according to each of the preceding embodiments, in addition to which other such means may be applicable for shifting of the change pin 8 to an aligned position of the plug pocket 5 and auxiliary pocket 11, i.e. shifting from the plug pocket 5 into the auxiliary pocket 11, or to the contrary may be operated by inserting from outside a magnet bar into a slot provided near the auxiliary pocket 5 in the cylindrical housing 1 or other mechanical means operable from outside.

Figure 19:
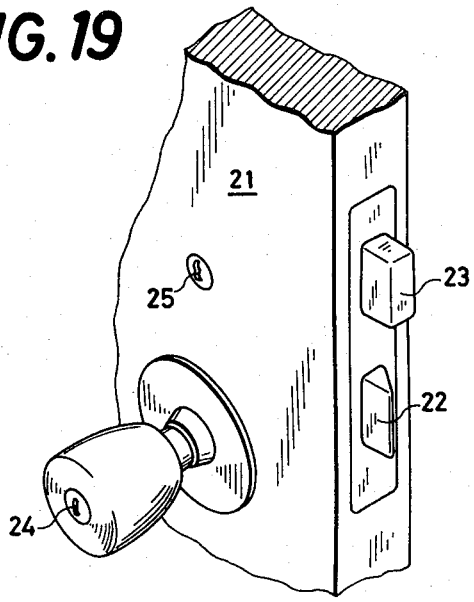
FIG. 19 is a perspective view showing a utility example of the lock according to the invention.

Above described embodiments have been confined to a lock assembly of pin tumbler type, but an example of its usefulness may now be referred to a door lock of a hotel guest room. FIG. 19 shows such an example. Reference number 21 designates a door, 22 a latch and 23 a dead bolt. A lock 24 is provided for exclusive use by a guest and another lock 25 for hotel administration purpose so that the guest and hotel will not use the same key-hole. The tumbler lock of this invention is mounted for exclusive use by the guest. By providing the pin tumbler lock of the present invention, unlocking conditions may be easily changeable without replacing its cylinder, and countermeasures for lost, stolen or duplicated keys can be assured of extremely easy and quick operation, ensuring safety measures against any attempt of illegal trespassing and the like. Furthermore, the hotel administration keys need no alteration for replacement of a guest's key, eliminating the drawbacks of a master key such as a maid's key or emergency key becoming no longer effective with a certain room, or of replacing the keys of all hotel rooms in order to replace one.

What is claimed is:

1. In a pin tumbler lock having a housing with a cylindrical bore, a cylinder provided with a key slot rotatable in said bore, at least one housing pocket provided in the cylindrical inner face of the housing, at least one auxiliary pocket in said cylindrical inner face of the housing circumferentially spaced from said housing pocket, at least one cylinder pocket in the cylindrical outer face of the cylinder alignable by rotation of the cylinder with the housing pocket and an auxiliary pocket, a support pin slidably disposed in each housing pocket and each auxiliary pocket resiliently urged by a spring inwardly in the direction of the key slot, one cylinder pin slidably guided in each cylinder pocket and at least one change pin slidably interchangeable between a housing pocket, cylinder pocket and auxiliary pocket, the improvement comprising:

engaging means engageable with the cylinder pin in each position of the change pin in alignment with a cylinder pocket for blocking relative circumferential movement between said change pin and said cylinder pin, and disengaging means for releasing said engaging means from the blocking position when said cylinder pocket is substantially aligned with said auxiliary pocket.

2. A pin tumbler lock as defined in claim 1, wherein said engaging means comprises said change pin having a substantially cylindrical body, a longitudinal bore through said cylindrical body, a blocking pin slidably guided within said bore, and a cavity in said cylinder pin, said blocking pin being engageable in said cavity, and said disengaging means comprises a magnetic body in said support pin in said auxiliary pocket adapted to attract said blocking pin to disengage it from said cavity.

3. A pin tumbler lock as defined in claim 2 wherein said disengaging means further comprises a conically tapered head on the end of said blocking pin facing said support pin, a cavity on the end of said support pin in said auxiliary pocket to receive said tapered head and a chamferred inner edge on the end of said cavity conforming to said tapered head.

4. A pin tumbler lock as claimed in claim 1 wherein said engaging means comprises said change pin having a main body portion and a projection in the direction of said cylinder, and a cavity in the end of said cylinder pin for receiving said projection in releasable engagement therewith, and said disengaging means comprises a tapered portion on said change pin between said main body portion and said projection decreasing in diameter towards said cylinder, a reduced diameter portion in said auxiliary pocket at the end thereof adjacent said cylinder, a guiding edge on said reduced diameter portion coacting with said tapered portion to move said change pin in the direction away from said cylinder to disengage said projection from said cavity when said cylinder is rotated with respect to said housing, and further comprising a projection on the end of said support pin in said auxiliary pocket facing said cylinder slidably engageable through said reduced diameter portion in said cylinder pocket.

5. A pin tumbler lock as claimed in claim 1 wherein said engaging means comprises said change pin having a bore therethrough substantially coaxial with said pockets, a blocking pin slidable within said bore, and a cavity in said cylinder pin to receive said blocking pin, and said disengaging means comprises spring means in said bore resiliently urging said blocking pin in the direction away from said keyslot, and further comprising an actuating projection on the end of said support pin in said housing pocket adjacent said cylinder engageable with the end of said blocking pin facing said housing for moving said blocking pin into engagement in said cavity of said cylinder pin against the force of said blocking pin spring means.

6. A pin tumbler lock as claimed in claim 1 wherein said engaging means comprises said change pin having a bore therethrough substantially coaxial with said pockets, a blocking pin slidable within said bore, and a cavity in said cylinder pin to receive said blocking pin, and said disengaging means comprises a magnetic material in said support pin in said auxiliary pocket adapted to attract said blocking pin to disengage it from said cavity in said cylinder pin, and further comprising an actuating projection on the end of said support pin in said housing pocket adjacent said cylinder engageable with the end of said blocking pin facing said housing for moving said blocking pin into engagement in said cavity of said cylinder pin.

7. A pin tumbler lock as claimed in claim 1 wherein said engaging means comprises a cavity in said cylinder pin on the end thereof adjacent said housing, a blocking pin in the form of a magnetic rod slidably guided within said cavity, spring means in said cavity urging said blocking pin toward said housing, and a cavity in said change pin to slidingly receive a portion of said blocking pin, and said disengaging means comprises said support pin in said auxiliary pocket being a magnet having its poles in opposing relationship with respect to the poles of said magnet rod blocking pin to move said blocking pin against the force of said blocking pin spring means out of engagement with said cavity, and further comprising the force of the spring urging said support pin of said housing pocket being greater than the force of said blocking pin spring means.

8. A pin tumbler lock as claimed in claim 7 wherein said change pin comprises a plurality of annular stacked pin elements aligned in said cylinder pocket to slidably receive said blocking pin therethrough.

9. A pin tumbler lock as claimed in claim 1 wherein said engaging means comprising a cavity in the end of said cylinder pin facing said housing, a projection on the end of said change pin facing said cylinder releasably engageable in said cavity, the dimensions of said support pins, change pin, projection and cavity being such that when said change pin is fully inserted in said housing pocket, said projection extends into said cavity through the slide interface between said housing and cylinder to thereby prevent relative rotation therebetween and when said change pin is fully inserted in said auxiliary pocket said relative rotation is not prevented, and said disengaging means comprises the shape of said projection and cavity being such as to cooperatively function to move said change pin into said auxiliary pocket against the force of the auxiliary pocket spring when said cylinder is rotated with respect to said housing.

* * * * *